US005680819A

United States Patent [19]

Rose et al.

[11] Patent Number: 5,680,819

[45] Date of Patent: Oct. 28, 1997

[54] VEHICLE COMBINATION WITH AT LEAST TWO VEHICLES WITH STEERED SINGLE-WHEELSET CHASSIS

[75] Inventors: Rolf-Dieter Rose, Braunschweig; Raimund Jassat, Salzgitter; Hinnerk Stradtmann, Braunschweig, all of Germany

[73] Assignee: Linke-Hofmann-Busch GmbH, Salzgitter, Germany

[21] Appl. No.: 96,547

[22] Filed: Jul. 23, 1993

[30] Foreign Application Priority Data

Jul. 24, 1992 [DE] Germany ..... 9209966 U

[51] Int. Cl.[6] ..... B61F 5/00

[52] U.S. Cl. ..... 105/165; 105/167

[58] Field of Search ..... 105/167, 168, 105/4.3, 4.1, 4.4, 165, 166

[56] References Cited

U.S. PATENT DOCUMENTS

| | | | |
|---|---|---|---|
| 1,388,508 | 8/1921 | Brilhart | 105/168 |
| 2,834,303 | 5/1958 | Furrer | 105/168 |
| 2,908,233 | 10/1959 | Furrer | 105/168 |
| 2,921,539 | 1/1960 | Furrer | 105/168 |
| 4,860,666 | 8/1989 | Smith | 105/168 |
| 5,081,933 | 1/1992 | Lapp et al. | 105/168 |
| 5,277,127 | 1/1994 | Euwijk et al. | 105/168 |

FOREIGN PATENT DOCUMENTS

| | | | |
|---|---|---|---|
| 0196440 | 3/1958 | Austria | 105/168 |
| 0007225A1 | 7/1979 | European Pat. Off. . | |
| 0007225 | 1/1980 | European Pat. Off. . | |
| 0 054 830 | 7/1986 | European Pat. Off. . | |
| 0368403 | 5/1990 | European Pat. Off. | 105/168 |
| 0557892 | 9/1993 | European Pat. Off. | 105/167 |
| 0374705 | 9/1920 | Germany | 105/167 |
| 1082615 | 6/1960 | Germany . | |
| 4140126 | 6/1993 | Germany | 105/167 |
| 0585358 | 4/1993 | Japan | 105/167 |
| 0300386 | 9/1965 | Netherlands | 105/168 |
| 0162020 | 8/1933 | Switzerland | 105/168 |
| 0427889 | 7/1967 | Switzerland . | |

OTHER PUBLICATIONS

Ulrich Bergner Reduzierung des Bofenverschleisse durch Zwangssteuerungen Technik Jan. 1988.

*Primary Examiner*—Mark T. Le
*Attorney, Agent, or Firm*—McGlew and Tuttle

[57] ABSTRACT

To provide a vehicle combination consisting of at least two railborne vehicles with single-wheelset chassis with a coupling for the single-wheelset chassis, which guarantees the most accurate alignment possible of the single-wheelset chassis in the direction of the center of the track under all travel conditions, a serf-steering device (self-steering elasticity e), which permits self-steering of the single-wheelset chassis in combination with the steering mechanism, is connected to an essentially rigid steering device.

13 Claims, 16 Drawing Sheets

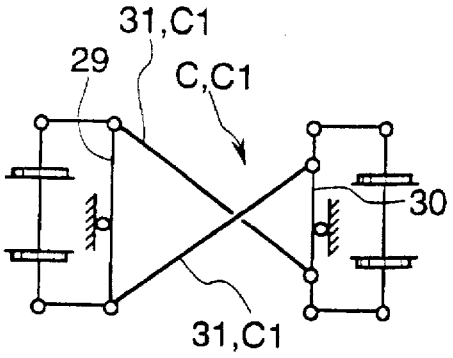
Fig. 18A
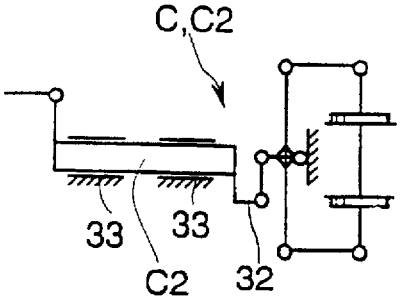
Fig. 18B
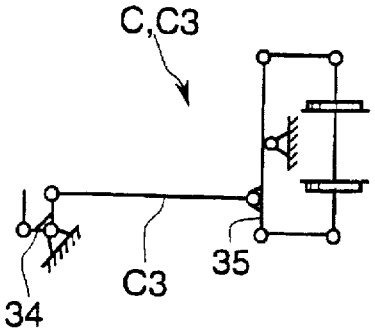
Fig. 20
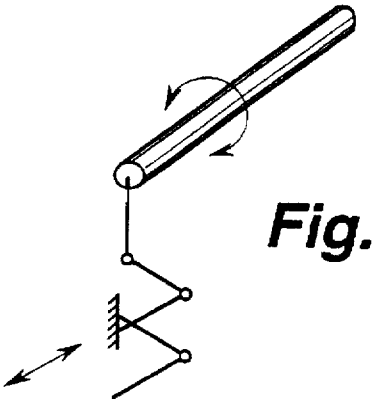
Fig. 19.1
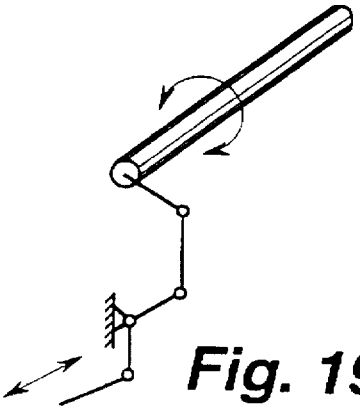
Fig. 19.2
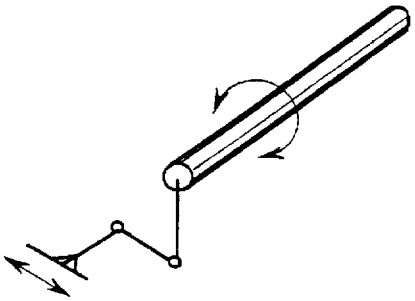
Fig. 19.3

VEHICLE COMBINATION WITH AT LEAST TWO VEHICLES WITH STEERED SINGLE-WHEELSET CHASSIS

FIELD OF THE INVENTION

The present invention pertains to a railborne vehicle combination with at least two vehicles with a vehicle steered single-wheelset chassis.

BACKGROUND OF THE INVENTION

Such a vehicle combination has been known from EP 0,054,830 A1, whose vehicle steering device, as well as a plurality of additional wheelset or chassis steering mechanisms are to steer the direction of rolling of the wheelsets into the direction of the center of the track during travel in curves as a function of the position of members of the vehicle. All the vehicle steering mechanisms used hitherto operate with rigid components and hinges, partly because of the small input and steering angles, and partly in order to achieve stretching of the wave-like movement of the wheelsets. This rigid coupling between the steering mechanism and steered components has the disadvantage that incorrect steering angles are caused when driving into and driving out of curves (literature reference Bergher: Reducing the Wear in Curves by Forced Steering Mechanisms, *Stadtverkehr*, 1/88, pp. 60–67). The rigid coupling also requires highly accurate basic setting in order for the wheelsets to run centrally (or at least with the smallest possible slip) during travel on a straight track. In addition, the rigid coupling elements transmit impacts of the chassis to the car bodies.

Furthermore, a plurality of self-steering wheelset chassis have been known, which make possible the automatic correct adjustment of the wheelset to the curve due to elastic or—by means of pendulums or chain links—gravity-dependent restoring coupling of the wheelset equipped with conical running treads (Megi or rubber scroll spring wheelset guidance and flexible axle). Because of the braking and driving forces to be transmitted, the coupling must be designed as a rigid coupling, which is disadvantageous for free adjustment, or fixed stops, which do not permit correct adjustment to the curve during braking or driving during bilateral contact of the wheelset bearings, are arranged on the frame.

SUMMARY AND OBJECTS OF THE INVENTION

The primary object of the present invention is to provide a coupling for single-wheelset chassis of a vehicle combination, with at least two railborne vehicles, which guarantees the most accurate alignment possible of the single-wheelset chassis in the direction of the center of the track in all states of the vehicle.

According to the invention, a railborne vehicle combination is provided including at least two vehicles with three steered single-wheelset chassis and including vehicle steering means and steering signals means for the single-wheelset chassis which signals are generated from an angular position of the two adjacent vehicles of the vehicle combination and including transmission means for transmitting the amount of vehicle steering and also including a chassis or wheelset coupling for positioning and turning in relation to the car body. The railborne vehicle combination further includes a chassis self-steering device (self-steering elasticity e) for the single-wheelset chassis. The chassis self steering device or self steering means permits self steering of the single-wheelset chassis in combination with the substantially rigid steering means. The chassis self-steering device (self-steering elasticity e) is connected to the essentially rigid vehicle steering means or steering device.

The chassis self-steering device (self-steering elasticity e) may be arranged within the steering angle pick-off device (means for providing the steering signal based on the angular position of the two adjacent vehicles). Further, as another possibility according to the invention, the self-steering device (self-steering elasticity e) may be arranged within the steering angle transmission means (means for transmitting the amount of steering). The self-steering device (self-steering elasticity e) may also be arranged within the chassis turning means or the self-steering device (self-steering elasticity e) may be arranged within the wheelset mounting.

The combination, according to the present invention, of self-steering and forced steering mechanism eliminates or alleviates the disadvantages of the self-steering wheelset chassis used hitherto, as well as those of the essentially rigid coupling of the wheelset or chassis steering mechanism.

As a result, the wheelset is enabled to automatically compensate the incorrect steering angles occurring when driving into and driving out of curves. In addition, if elastic elements are used between the wheelset and the steering linkages, these themselves and the steering car bodies are protected from longitudinal impacts of the wheelsets.

Compared with prior-art designs of only self-steering, not steered chassis, the combination of steering mechanism and self-steering offers the advantage that the self-steering movements are small during travel in curves due to the presetting and they are influenced by driving and braking forces only insignificantly at best.

The self-steering of the single-wheelset chassis by driving and/or braking forces is practically not impaired by the design and arrangement of the self-steering elasticity (serf-steering elasticity arranged within steering pick-off device or arranged within the steering angle transmission means).

The various features of novelty which characterize the invention are pointed out with particularity in the claims annexed to and forming a part of this disclosure. For a better understanding of the invention, its operating advantages and specfic objects attained by its uses, reference is made to the accompanying drawings and descriptive matter in which preferred embodiments of the invention are illustrated.

BRIEF DESCRIPTION OF THE DRAWINGS

In the drawings:

FIG. 18A is a top view showing a design for transmitting the steering angle via traction elements;

FIG. 18B is a top view showing a design for transmitting the steering angle via torsion elements;

FIGS. 19.1–19.3 are perspective schematic views of the design shown in FIG. 18B;

FIG. 20 is a top view of a design for transmitting the steering angle via pull-push elements;

DETAILED DESCRIPTION OF THE PREFERRED EMBODIMENT

The combination of an extensively rigid vehicle steering mechanism and chassis self-steering of single-wheelset chassis can be used for articulated sets as well as for permanently or temporarily coupled single vehicles.

Figure 1:
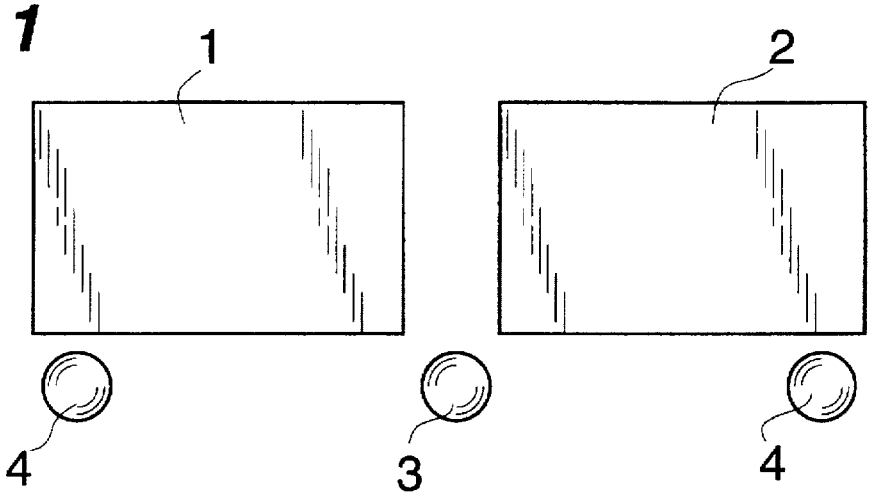
FIG. 1 is a side view of a vehicle combination with two vehicles and three single chassis.
Figure 2:
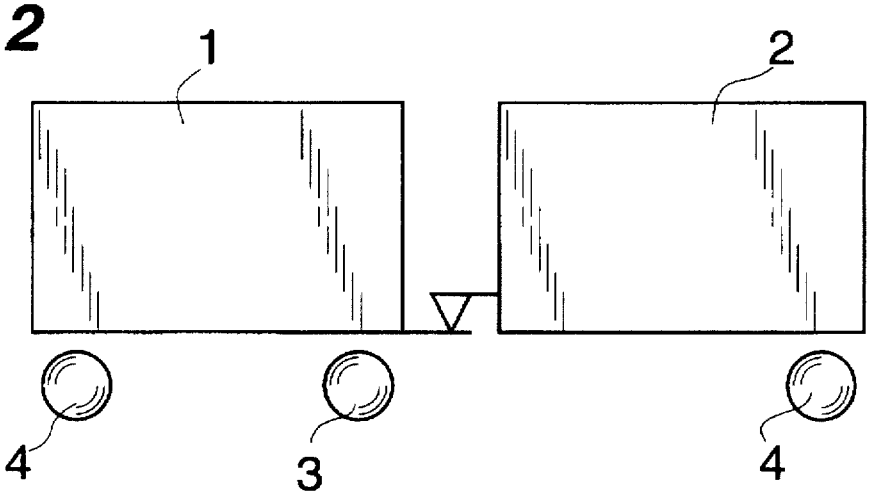
FIG. 2 is a side view of another vehicle combination with two vehicles and three single chassis.

The smallest vehicle combination of two vehicles 1, 2 or of two car bodies and three single chassis 3, 4, namely, a middle single chassis 3 and two end chassis 4, is shown in FIGS. 1 and 2. The car bodies of the two vehicles 1, 2 are supported at their ends on an end chassis 4 each. The ends of the car bodies of the vehicles 1, 2 facing each other are supported together on a middle single chassis 3, e.g., either in a Jacobs arrangement or via a fifth wheel.

Figure 3:
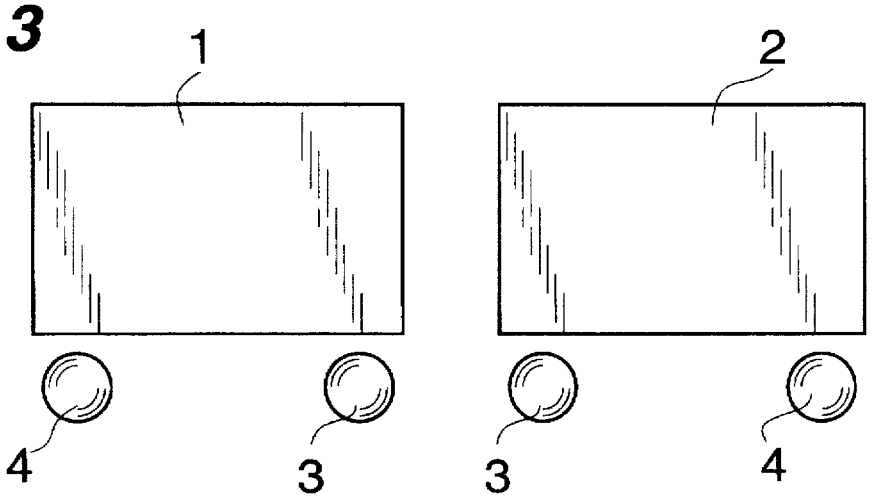
FIG. 3 is a side view of a vehicle combination with two vehicles and four single chassis.

A vehicle combination of two vehicles 1, 2 or two car bodies with four single chassis is shown in FIG. 3. The car bodies of the two vehicles 1, 2 are supported in this design with their ends facing each other on a separate single chassis 3 each.

Figure 4:
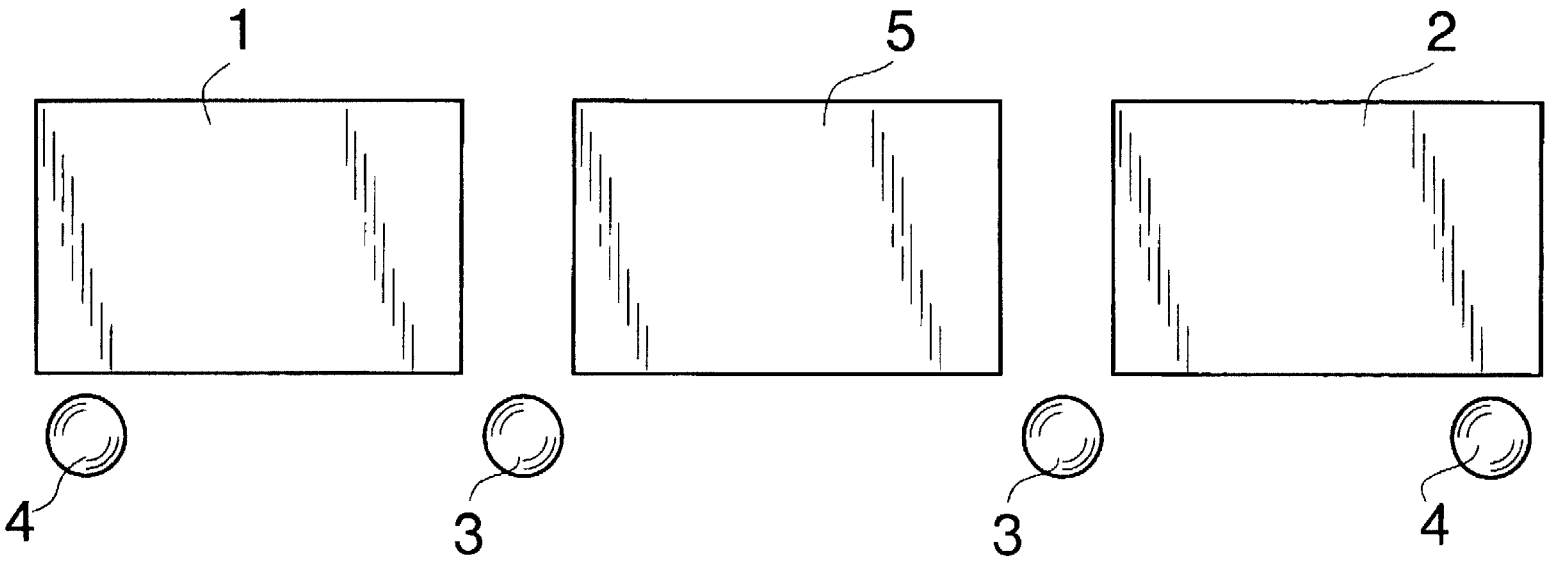
FIG. 4 is a side view of a vehicle combination with three vehicles and four single chassis.
Figure 5:
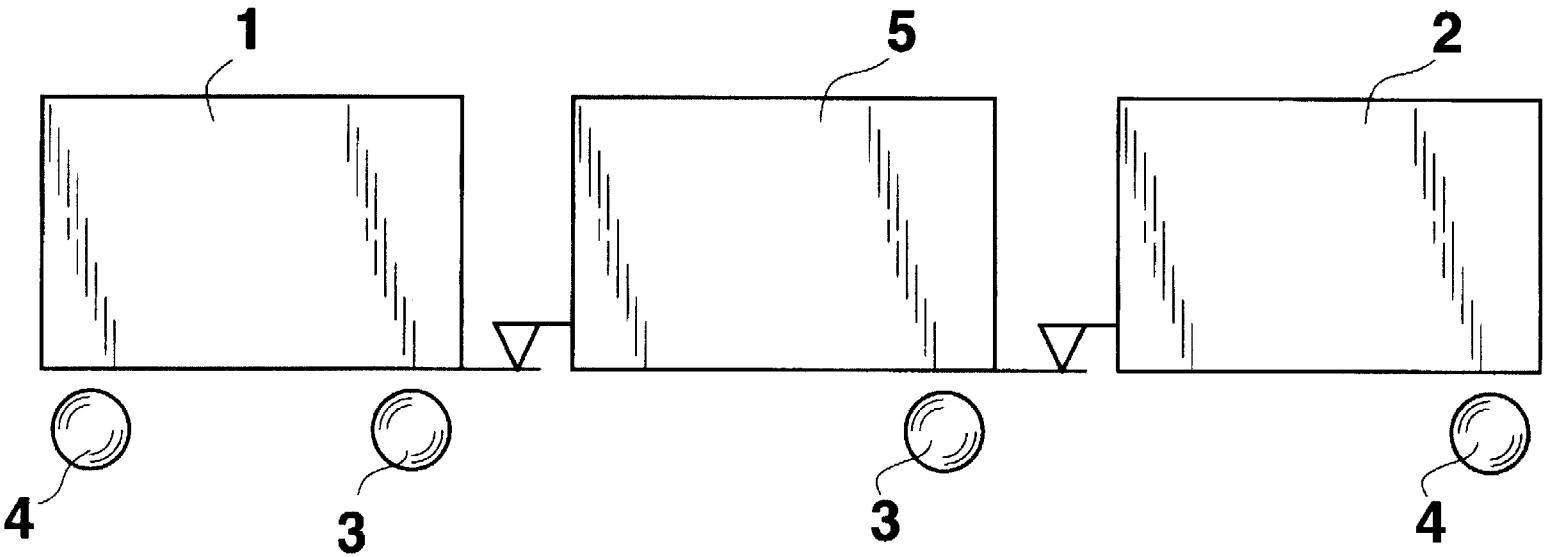
FIG. 5 is a side view of another vehicle combination with three vehicles and four single chassis.
Figure 6:
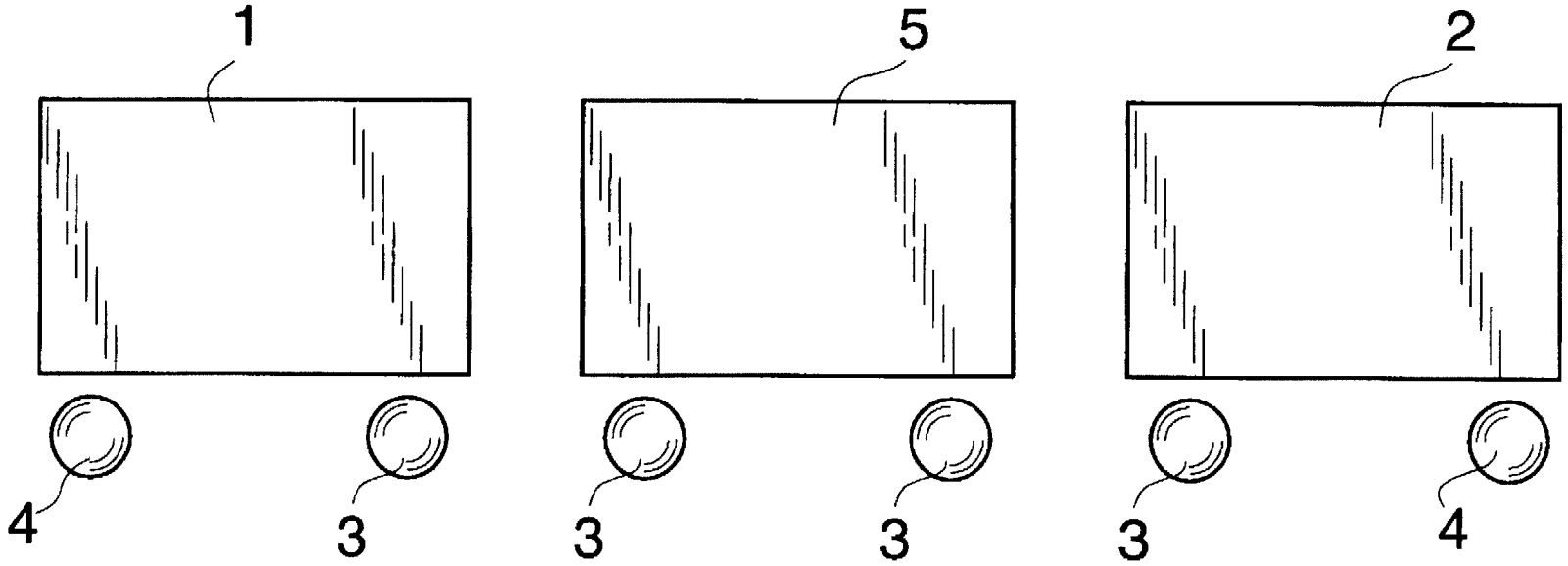
FIG. 6 is a side view of a vehicle combination with three vehicles and six single chassis.

It is possible to form vehicle combinations of and length by inserting intermediate cars 5. The number and the function of the end chassis 4 do not change. The number of the middle chassis 3 increases, depending on the type of the vehicle combination, by one middle chassis 3 per additional intermediate car 5 (see FIG. 4 as a continuation of the chain of vehicles according to FIG. 1 and FIG. 5 as a continuation of the chain of vehicles according to FIG. 2), or by two middle chassis 3 (see FIG. 6 as a continuation of the chain of vehicles according to FIG. 3).

Figure 7:
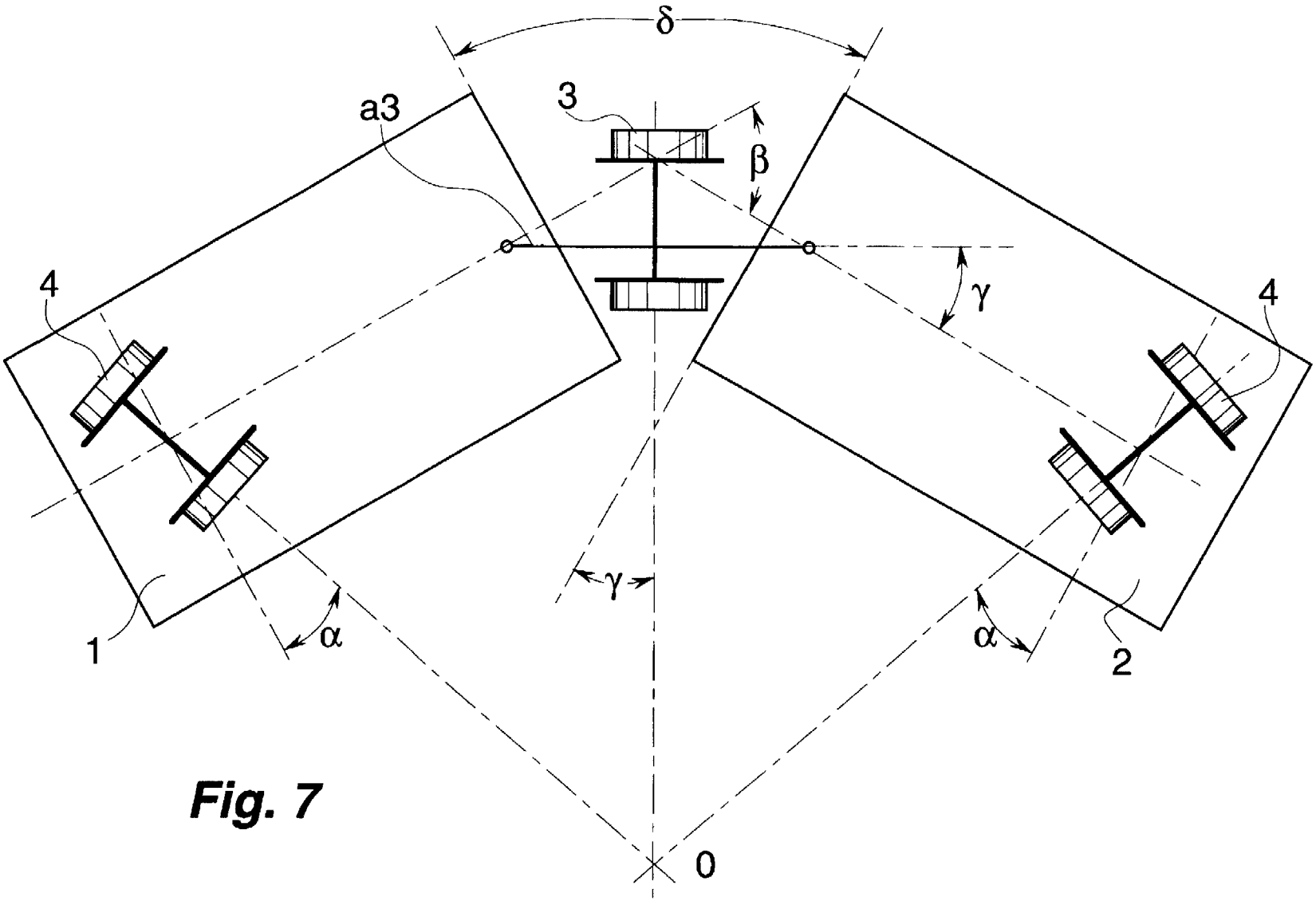
FIG. 7 is a top view of a vehicle combination with two vehicles and three single chassis in a track curve, with indication of the reference system for different turning angles and steering angles.

It is common to all vehicle combinations that both the end chassis 4 and the middle chassis 3 are adjusted in track curves by the vehicle steering mechanism, i.e., they are to be turned around their vertical axes according to the present invention (FIG. 7).

Some definitions of angles shall first be given for the representation in FIG. 7:

$\alpha$—turning angle of the end chassis 4 (outer chassis), $\gamma$—turning angle of the said middle chassis 3, $\beta$—buckling angle of the vehicle combination in relation to the longitudinal axis of the vehicle, $\delta$—vehicle steering angle (in relation to the end walls of the car bodies of the vehicles 1, 2), $\kappa$—vehicle coupling steering angle (relative steering lock) of the drawbar in relation to the vehicle longitudinal axis of two vehicles hinged together via a drawbar.

In the example shown in FIG. 7, two car bodies of the vehicles 1, 2 with one end chassis 4 each are supported at the ends facing each other via a common middle chassis. The car bodies of the vehicles 1, 2 are hinged to each other via a drawbar.

The chassis 3, 4 roll nearly ideally when the wheel axes point toward the center of curvature of the track. This means that the axes of the wheelsets of the end chassis 4 must be pivoted by the angle $\alpha$ (turning angle $\alpha$) in relation to the transverse axis of the vehicle. The wheelset of the middle chassis 3, which is arranged in the vicinity of the connection point between two vehicles 1, 2, must be pivoted by the angle $\gamma$ (turning angle $\gamma$) in relation to the transverse axis of the vehicle. The vehicle longitudinal axes of two adjacent vehicles 1, 2 intersect in the track curve at an angle $\beta$ (buckling angle $\beta$).

A corresponding angle $\delta$ can also be found between the end walls of adjacent vehicles 1, 2. The end walls no longer extend in parallel, as on a straight track. Travel in a track curve can also be recognized from the relative steering lock of the drawbar a3 in relation to the longitudinal axis of the vehicle by the angle $\kappa$.

The angles $\beta$, $\delta$ or $\kappa$ can be used as vehicle steering angles to generate the desired chassis angles $\alpha$ or $\gamma$.

To provide a single-wheelset chassis within a vehicle combination with a vehicle steering mechanism (forced steering) and chassis self-steering, the following elementary functions must be embodied:

—designing the vehicle connection (vehicle connection a),

—vehicle steering angular movement pick-off (steering angle pick-off b),

—transmission of the amount of steering (amount of steering transmission c),

—turning of the chassis to be steered (chassis turning d),

—superimposition of the elasticity necessary for chassis self-steering (self-steering elasticity e).

There are several design solutions for each of these elementary functions. Mechanically operating solutions will be described as examples below. Hydraulically or electrically operating solutions can easily be derived from this.

In principle, each of the solutions described below for an individual elementary function can be combined with any solution to all other elementary functions. Particularly suitable combinations of solutions are shown as examples in FIGS. 26, 27 and 28 and will be described below.

Figure 8:
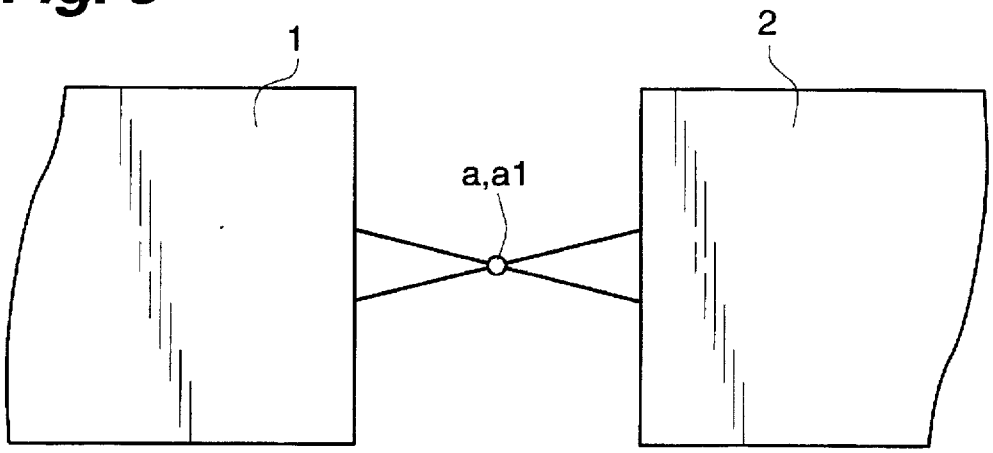
FIG. 8 is a top view showing a design of a vehicle connection by means of a hinge.

The vehicle connection a between adjacent vehicles is usually brought about by hinges a1, fifth wheels a2 or drawbars a3. FIG. 8 shows two vehicles 1, 2 with a hinge connection a1.

Figure 9:
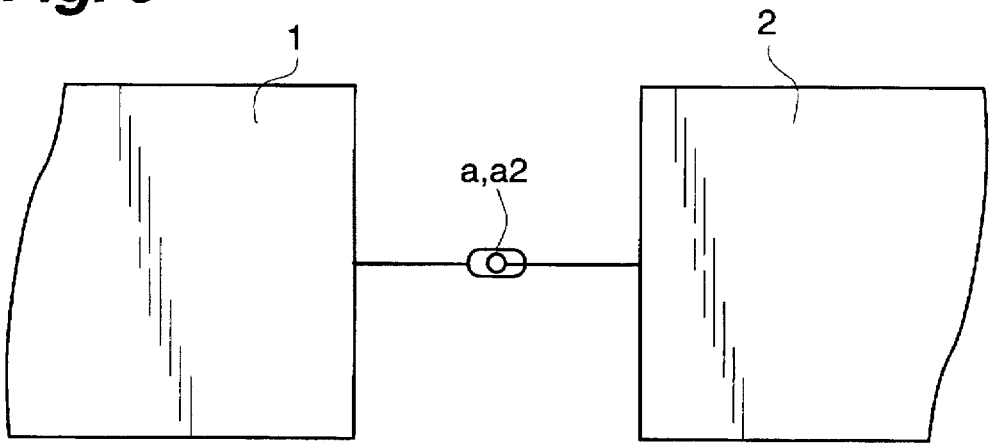
FIG. 9 is a top view showing a design of a vehicle connection by means of a fifth wheel.

FIG. 9 shows two vehicles 1, 2 with a fifth wheel a2, wherein one of the two vehicles 2 is supported on the other vehicle 1.

Figure 10:
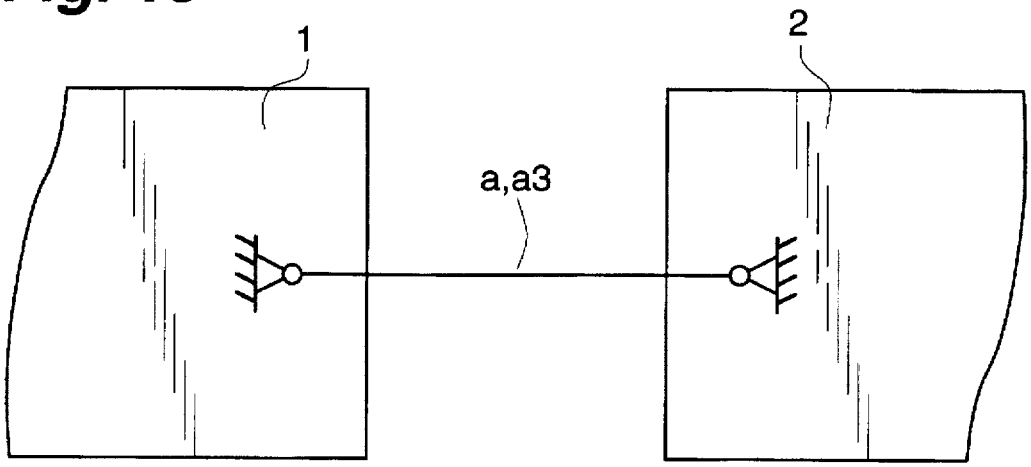
FIG. 10 is a top view showing a design of a vehicle connection by means of a drawbar.

FIG. 10 shows two vehicles 1, 2, which are connected by a drawbar a3.

All vehicle connections a may be designed as connections that are rigid or elastic in the longitudinal direction of the vehicle.

Design embodiments which are suitable for steering angle pick-off b are shown in FIGS. 11 through 17.

Group b1 of the designs, which is suitable for picking off the end wall angle δ, is shown in FIG. 11 through FIG. 14.

Figure 15:
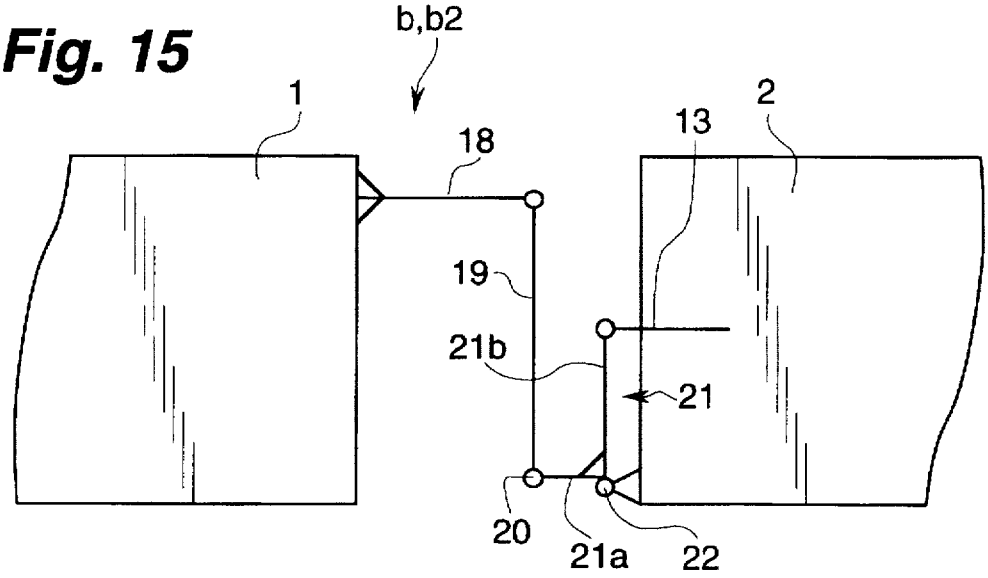
FIG. 15 is a top view showing a design for the steering angular movement pick-off via the vehicle longitudinal angle.

A design b2, which is suitable for picking off the vehicle longitudinal axis β, is shown in FIG. 15.

Figure 16:
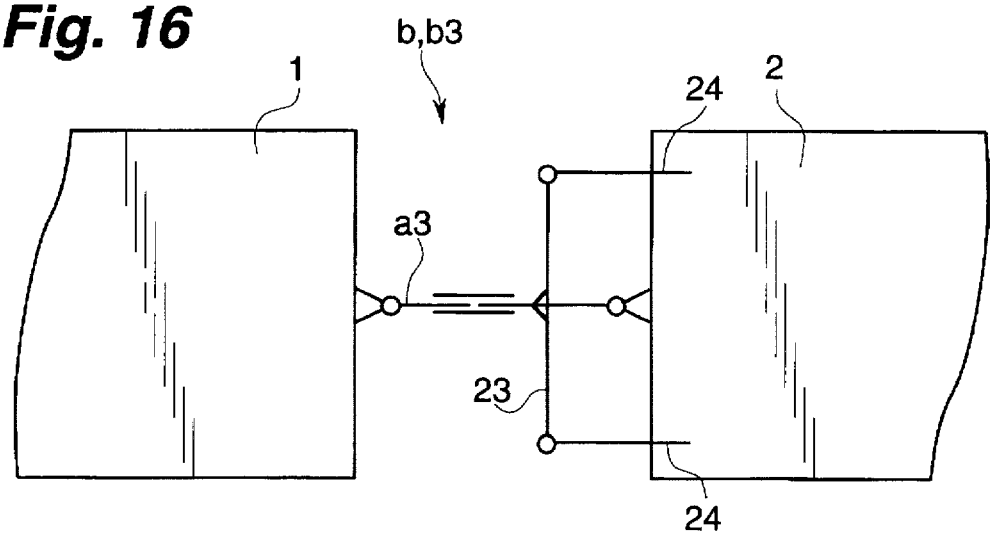
FIG. 16 is a top view showing a design for the steering angular movement pick-off via the coupling angle.
Figure 17:
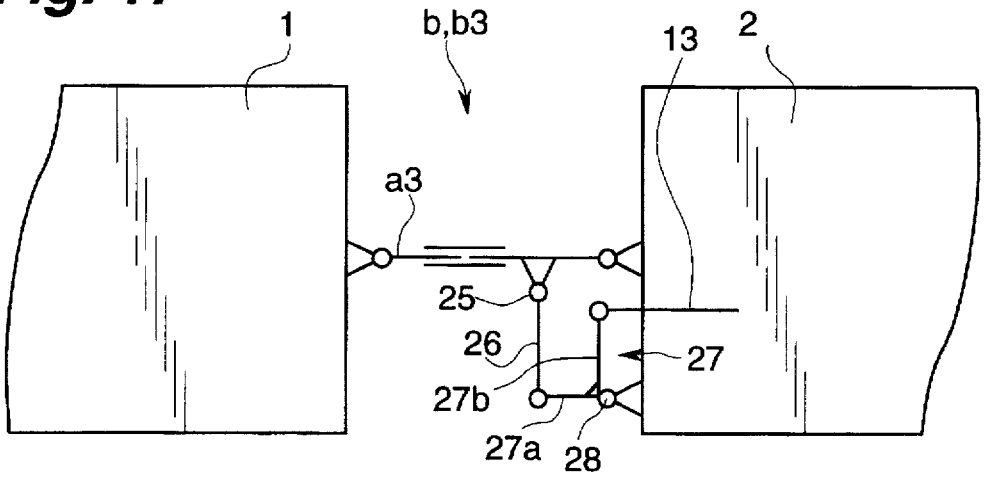
FIG. 17 is a top view showing another design for the steering angular movement pick-off via the coupling angle.

The group of designs b3, which are suitable for picking off the coupling angle κ, is shown in FIG. 16 and FIG. 17.

Figure 11:
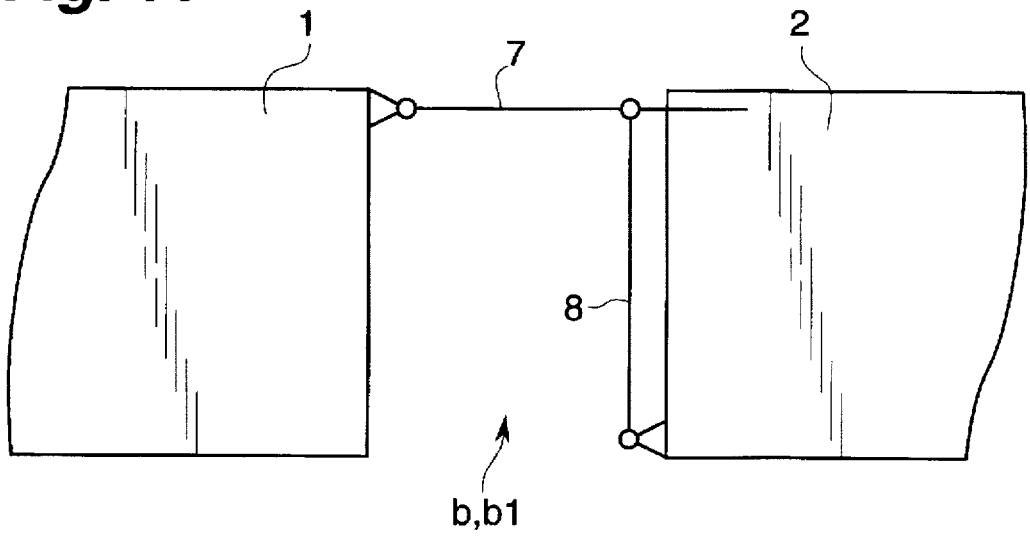
FIG. 11 is a top view showing a design for steering angular movement pick-off via the end wall angle.
Figure 12:
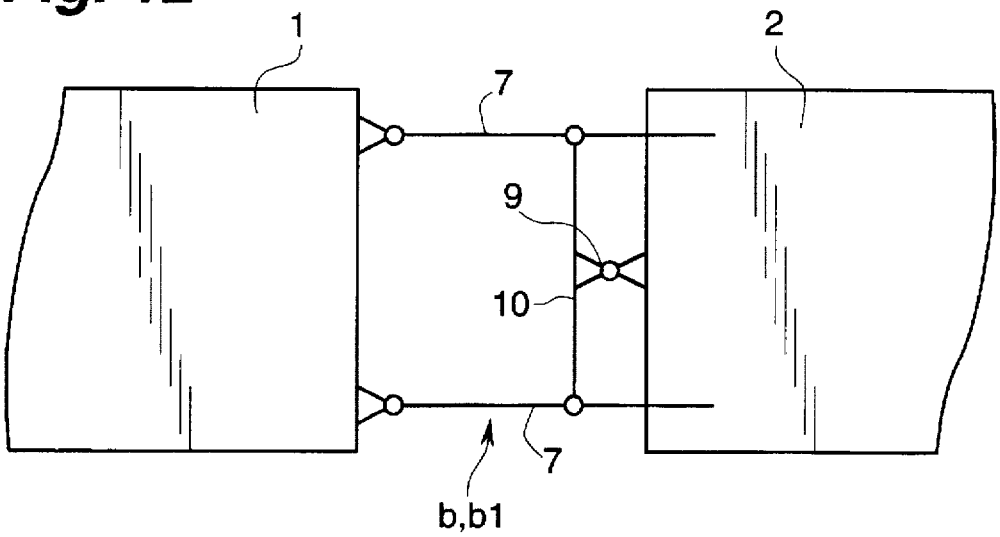
FIG. 12 is a top view showing another design for the steering angular movement pick-off via the steering angle.
Figure 13:
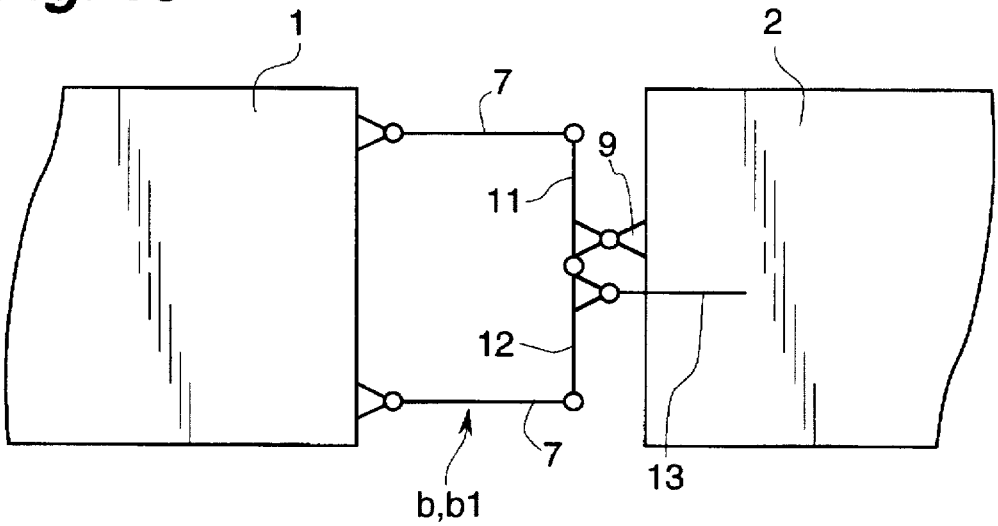
FIG. 13 is a top view showing another design for the steering angular movement pick-off via the steering angle.
Figure 14:
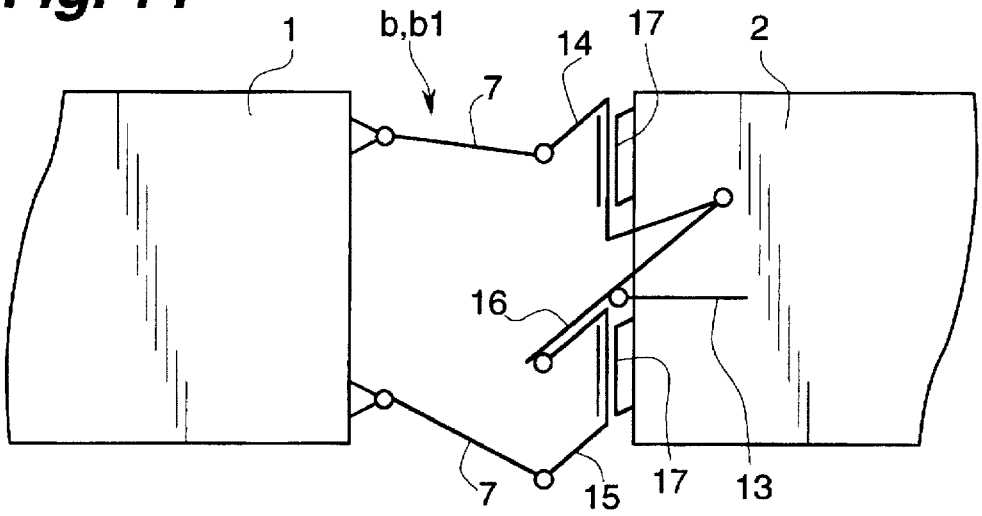
FIG. 14 is a top view showing another design for the steering angular movement pick-off via the steering angle.

The group of designs b1, which are suitable for picking off the end wall angle δ only for vehicles 1, 2 rigidly connected to each other in the longitudinal direction, is shown in FIG. 11 and FIG. 12, while the designs b1 according to FIG. 13 and FIG. 14 are also suitable for vehicle connections designed as longitudinally elastic vehicle connections.

FIG. 11 shows two vehicles 1, 2, which are rigidly coupled in the longitudinal direction. A steering rod 7, which is hinged to vehicle 1 and is mounted longitudinally displaceably on the other vehicle 2, e.g., via a connecting rod 8, is arranged in parallel next to the longitudinal axes of the vehicles.

FIG. 12 shows two vehicles 1, 2, which are rigidly coupled in the longitudinal direction. The steering rods 7 are arranged in a hinged manner on the vehicle 1 outside the longitudinal axis of the vehicle. A lever 10, which is connected at its ends to the steering rods 7 in a hinged manner, is mounted on the vehicle 2 in a bearing 9. This arrangement for the steering angle pick-off b can also be used for the vehicle connection a at the same time.

FIG. 13 shows two vehicles 1 and 2, which are connected to each other rigidly or elastically in the longitudinal direction. Two steering rods 7, which are arranged in parallel off-center, are hinged to the vehicle 1 and act on a lever bar, which is able to eliminate the incorrect steering angle by longitudinal movements of the vehicles in relation to one another. A lever 11 is hinged to the vehicle 2 via a bearing 9. Another lever 12 is attached to the lever 11 and to the associated steering rod 7. The respective outer and inner lever legs are of equal length. A steering rod 13 for the amount of steering transmission c is coupled to the lever 12.

FIG. 14 shows two vehicles 1 and 2, which are connected rigidly or elastically in the longitudinal direction. The steering rods 7, which are arranged off-center in parallel, act on a compensating linkage, which consists of two crankshafts 14 and 15, whose crank ends facing each other are connected by a lever 16. The crankshafts 14 and 15 are mounted on the vehicle 2 in a bearing 17 each. The respective outer and inner crank arms are of equal length. A steering rod 13 for the mount of steering transmission c is coupled to the lever 16.

A design b2, which is suitable for steering angle pick-off via the vehicle longitudinal angle β, is shown in FIG. 15. The vehicles 1 and 2 are connected to one another rigidly or elastically in the longitudinal direction. An extension arm 18 is rigidly arranged off-center on the vehicle 1. A connecting rod 19, which extends to the other side of the vehicle 1 vertically beyond the longitudinal center plane and is connected to an angle lever 21 via a hinge 20, is coupled to the other end. The first lever arm 21*a* of the angle lever 21 is parallel to the longitudinal axis of the vehicle, and the second lever arm 21*b* is arranged at fight angles thereto (β=0°) and extends in the direction of the vertical longitudinal center plane. The angle lever 21 is supported in its knee portion in a bearing 22 on the vehicle 2. The bearing 22 is arranged off-center on the side opposite the extension arm 18 in relation to the longitudinal axis of the vehicle. A steering rod 13 for the amount of steering transmission c is coupled to the end of the lever arm 21*b*.

Thus, the extension arm 18, which is rigidly connected to the vehicle 1, transmits the steering movements to the steering rod 13 via the connecting rod 19 and the angle lever 21 mounted on the vehicle 2.

Designs b3 for steering angle pick-off via the coupling angle κ are shown in FIGS. 16 and 17.

The vehicles 1 and 2 in FIG. 16 are connected to each other by the drawbar a3. A transverse lever 23 is rigidly attached to and at right angles to the drawbar a3. Steering rods 24 are hinged to each end of the transverse lever 23. The transverse lever 23 may also be of a one-sided design and have only one steering rod 24 for the amount of steering transmission c.

FIG. 17 shows two vehicles 1 and 2, which are connected to one another rigidly or elastically in the longitudinal direction and are connected by a drawbar a3 arranged in the vertical longitudinal center plane of the vehicle.

A bearing 25 is arranged on the side of one of the vehicles (vehicle 2) at the drawbar a3. A connecting rod 26, which is linked to a lever arm 27*a* of an angle lever 27, which is supported in its knee on the vehicle 2 via a bearing 28 in a hinged manner, is coupled to the bearing 25 at right angles to the longitudinal axis of the vehicle to one side of the vehicle. The second lever arm 27*b* of the angle lever 27, whose lever arms 27*a* and 27*b* are preferably arranged at an angle of 90°, extends from the bearing 28 in the direction of the longitudinal axis of the vehicle. A steering rod 13 for the amount of steering transmission c is coupled to the end of the lever arm 27*b*.

Mechanical designs for the mount of steering transmission c are shown in FIGS. 18A, 18B and 20, and will be described in greater detail below. It is also possible to use corresponding, equivalent, hydraulically or electrically operating transmission means, which are not shown.

FIG. 18A shows a transmission means c with traction elements e1. Two levers 29 and 30, which are mounted on the vehicle, are connected by traction elements 31, e.g., in a cross anchor arrangement.

FIG. 18B shows, together with FIGS. 19.1, 19.2 and 19.3, a transmission means with a torsion element c2. The torsion element c2 has end-side cranks 32, 33 and is supported on the vehicle 2 via a bearing 33. A crank 32 is connected to the device for steering angle pick-off b, and the crank 32 arranged at the other end of the torsion element c2 is connected to the chassis-turning means d. FIGS. 19.1, 19.2 and 19.3 show how a longitudinal movement and a transverse movement are transmitted as a rotary movement via the crank 32 to the torsion element c2.

FIG. 20 shows a transmission means with pull-push element c3. The pull-push element c3 takes over the steering movement from the means for the steering angular movement pick-off b (here a triangle lever 34) and transmits it to the chassis-turning means d (here lever 35).

Embodiments of the chassis- or vehicle-turning means d are shown in FIGS. 21 through 24 and will be described in greater detail below.

Figure 21:
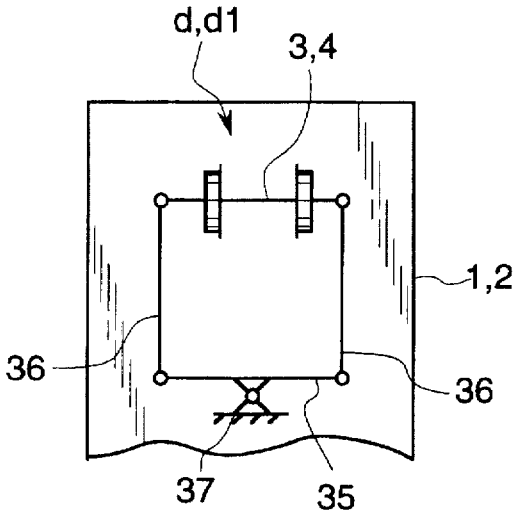
FIG. 21 is a top view of a design for turning the vehicle by means of a lever-connecting rod means.

A lever-connecting rod means d1 is shown in FIG. 21. The lever 35 is mounted centrally on the vehicle 1, 2 via a bearing 37. Connecting rods 36, whose other ends are coupled to one side each of the vehicles 3, 4, are coupled to the ends of the lever 35.

Figure 22:
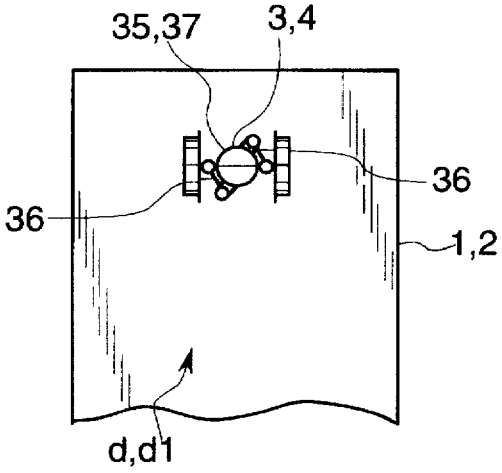
FIG. 22 is a top view of another design for turning the vehicle by means of a lever-connecting rod means.

A lever-connecting rod means d1 is shown in FIG. 22 as well. The bearing 37 on the car body of the vehicles 1, 2 is designed as a fifth wheel here.

Figure 23:
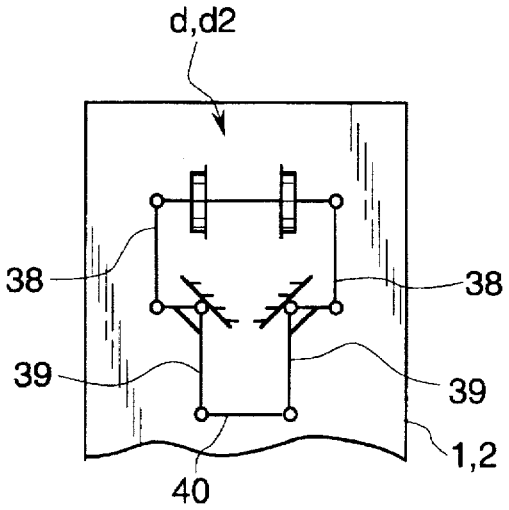
FIG. 23 is a top view of a design for turning the vehicle by means of a triangle lever.

FIG. 23 shows a chassis-turning means d2, which has a connecting rod 38, an angle lever (triangle lever 39), and a connecting rod 40 in an arrangement which is mirror-symmetrical to the longitudinal center plane. Two triangle levers 39, which are connected to one another via the connecting rod 40, on the one hand, and to the chassis 3, 4 via the connecting rods 38 (longitudinal connecting rods), on the other hand, are coupled to the vehicles 1,2.

Figure 24:
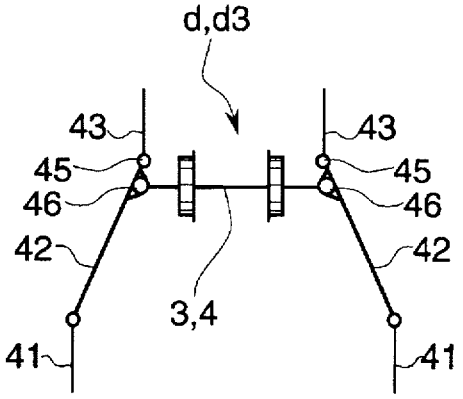
FIG. 24 is a top view of a design for turning the vehicle with a lemniscate connecting rod arrangement.

FIG. 24 shows a so-called lemniscate connecting rod arrangement of a chassis-turning means d3, in which longitudinal connecting rods are suitable for designing the steering angle pick-off b function (e.g., longitudinal connecting rod 43) and the steering angle transmission c function (longitudinal connecting rod 41). A longitudinal connecting rod 41 is linked by means of a hinge 44 to the end of a lever 42, which end points toward the chassis. Another longitudinal connecting rod 43, which in turn is connected to the vehicle 1, 2, is linked to the other end of the lever 42 by means of a hinge 45. A bearing 46 for coupling the chassis 3, 4 is provided between the hinges 44 and 45. The longitudinal connecting rods 41, 43 and the lever 42 are arranged in pairs, mirror-symmetrically to the vertical longitudinal center plane.

If the chassis is arranged as an end chassis 4 of a train, the longitudinal connecting rods 41 also form part of the transmission device c.

If the chassis is arranged as a middle chassis 3 within a train, the longitudinal connecting rods 41 can be connected to one vehicle (vehicle 1), and the connecting rods 43 can be connected to the adjacent vehicle (vehicle 2) (steering angle pick-off b).

Figure 25:
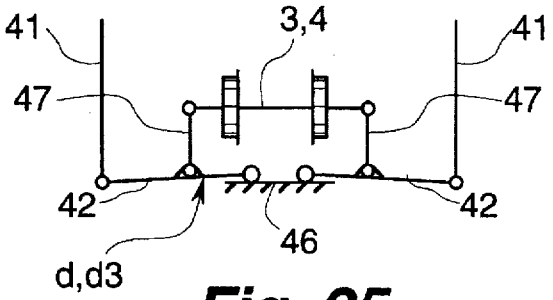
FIG. 25 is a top view of another design for turning the vehicle with a lemniscate connecting rod arrangement.

FIG. 25 shows a vehicle-turning means d3 of the same type, but the lever 42 of the lemniscate connecting rod arrangement, which is arranged in pairs and is likewise mirror-symmetrical to the vertical longitudinal center plane, is mounted in a bearing 46 here. The connecting rods 41 transmit the steering movement to the levers 42, which are mounted on the vehicle 1, 2 and steer the chassis 3, 4 via connecting rods 47.

Figure 26:
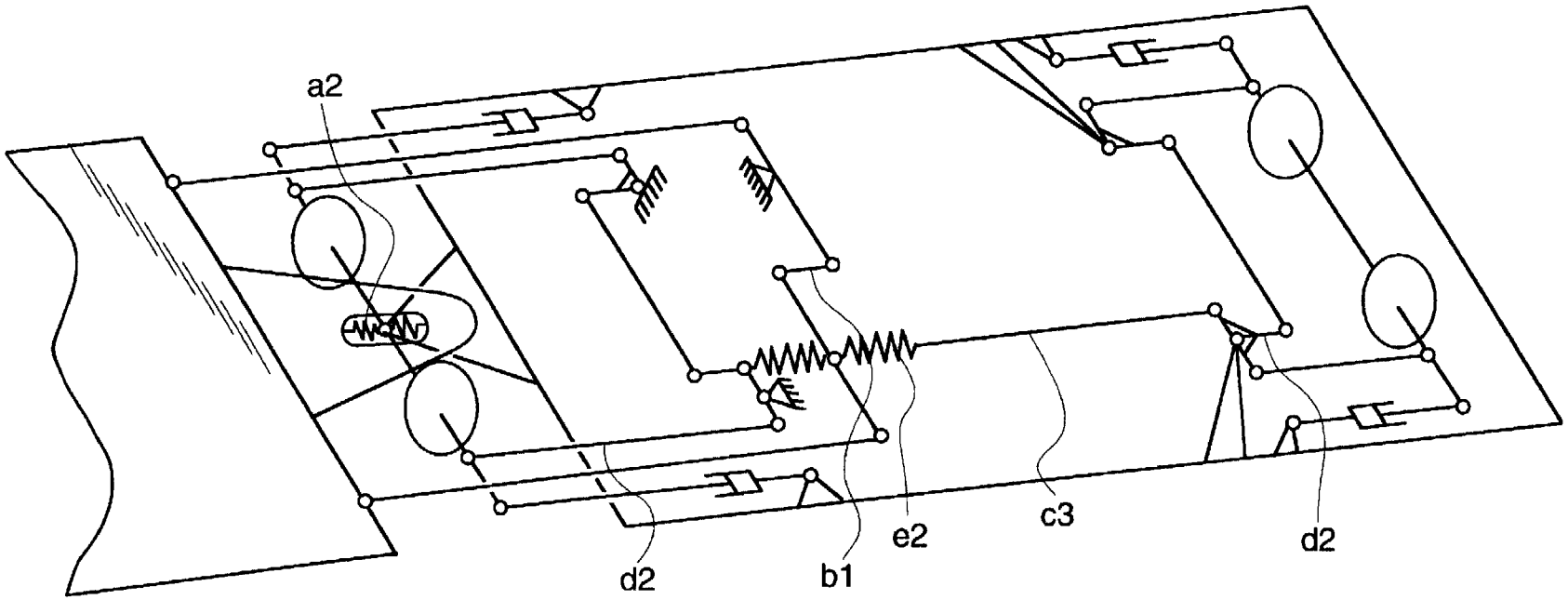
FIG. 26 is a schematic representation of an example according to the present invention, in which the self-steering elasticity is designed in connection with the means for transmitting the steering angle (e2)

The chassis fifth elementary function, namely, the self-steering elasticity e for self-steering, can be represented by designing an elasticity within the elementary function steering angle pick-off b as an elastic steering angle pick-off e1 (see element e1 in FIG. 27) or by designing an elasticity within the elementary function steering angle transmission c as an elastic amount of steering transmission e2 (see element e2 in FIG. 26).

Figure 28:
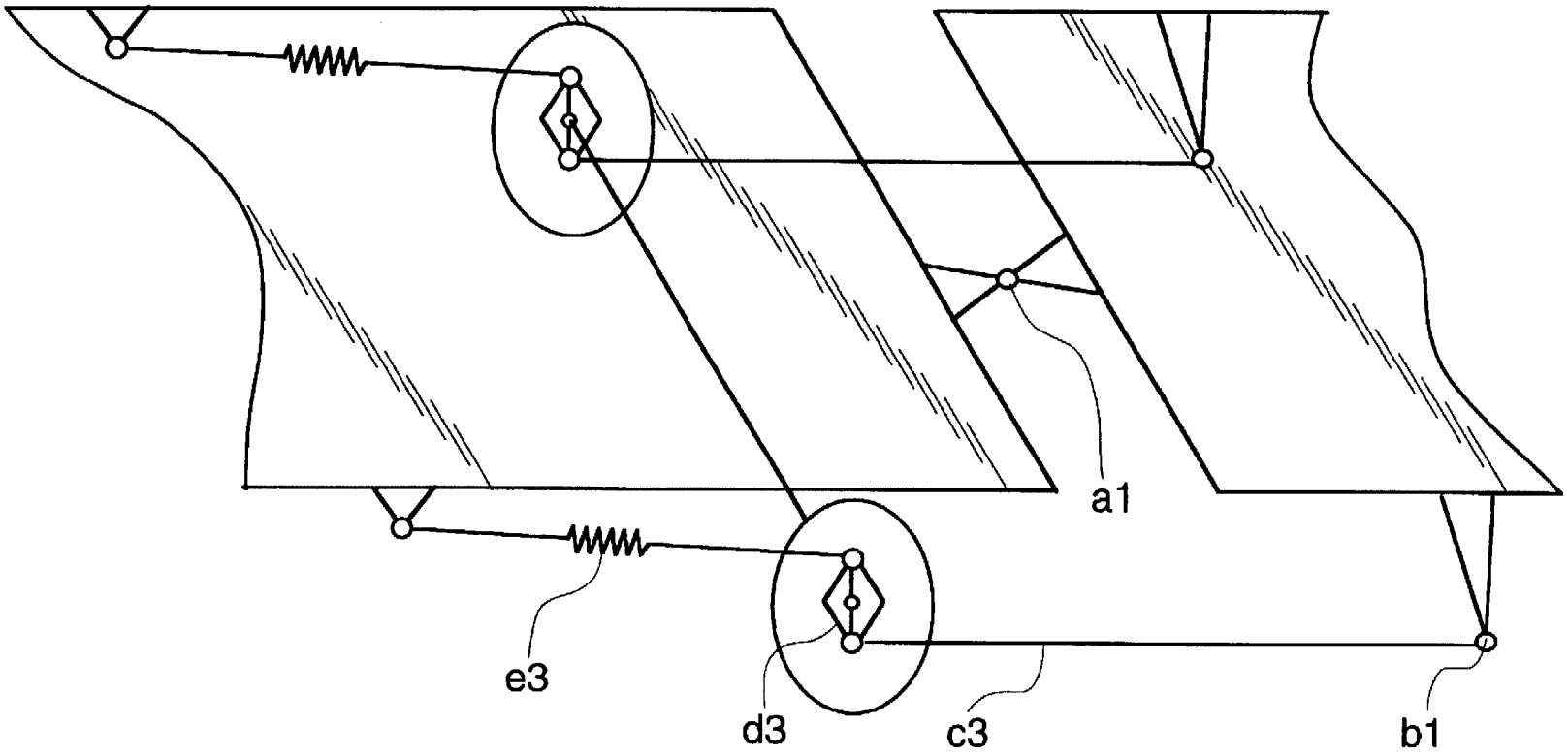
FIG. 28 is a schematic representation of another example according to the present invention, in which the self-steering elasticity is designed in connection with the vehicle turning means (e3)
Figure 29:
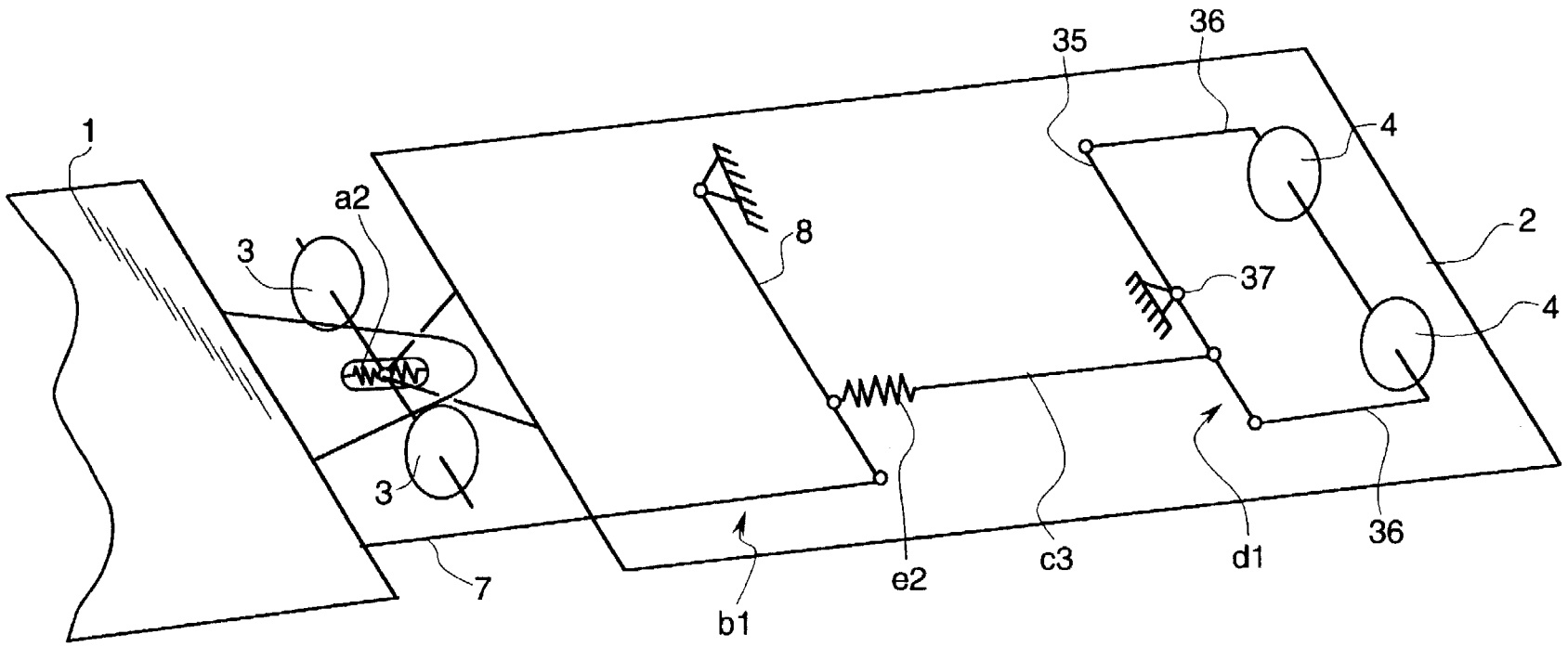
FIG. 29 is a schematic representation of another example according to the present invention, in which the self-steering elasticity is designed in connection with the device for steering angular movement pick-off.

It is also possible to provide for the necessary chassis self-steering elasticity e by designing an elasticity within the elementary function chassis turning d (see element e3 in FIG. 28).

It is also possible to provide for the necessary self-steering elasticity by designing an elasticity within the wheelset bearing in the chassis 3, 4 (wheelset bearing elasticity e4).

Each of the devices for self-steering the chassis (chassis self-steering elasticity e) consists of the following components:

Wheelset with linear or preferably wear-adjusted, conical running treads and restoring devices operating depending on a spring force or/and gravity, e.g., chain links or pendulums.

As was explained above, this self-steering elasticity or flexibility may be arranged in the devices for steering angle pick-off e1 and/or for steering angle transmission e2 and/or for chassis turning e3 and/or wheelset mounting e4, which were described in the introduction.

The self-steering elasticity is preferably used in the design e1 and/or e2, because the driving and braking forces do not impair self-steering in these designs. The elasticity may be achieved with, e.g., spring elements and/or rubber-elastic hinge connections and/or rubber-elastic wheelset guides and/or chain link/pendulum suspensions, or, in hydraulically operating devices, with pneumatic springs. Damping devices may be arranged, if necessary, in parallel to the elasticities.

Vehicle combinations with designs or design solutions for the elementary functions vehicle connection a, steering angle pick-off b, amount of steering transmission c, chassis turning d, and self-steering elasticity e can thus be assembled from the design matrix (solution matrix) described below.

| Elementary Function | Design Matrix | | | | | |
|---|---|---|---|---|---|---|
| Vehicle connection a | a1 | a2 | a3 | ... | ... | $a_n$ |
| Steering angle pick-off b | b1 | b2 | b3 | ... | ... | $b_n$ |
| Amount of steering transmission c | c1 | c2 | c3 | ... | ... | $c_n$ |
| Chassis turning d | d1 | d2 | d3 | ... | ... | $d_n$ |
| Self-steering elasticity e | e1 | e2 | e3 | e4 | ... | $e_n$ |

The example according to FIG. 26 is formed by the combination of the above-described elements a2, b1, c3, d2, and e2 of the design (solution) matrix.

Figure 27:
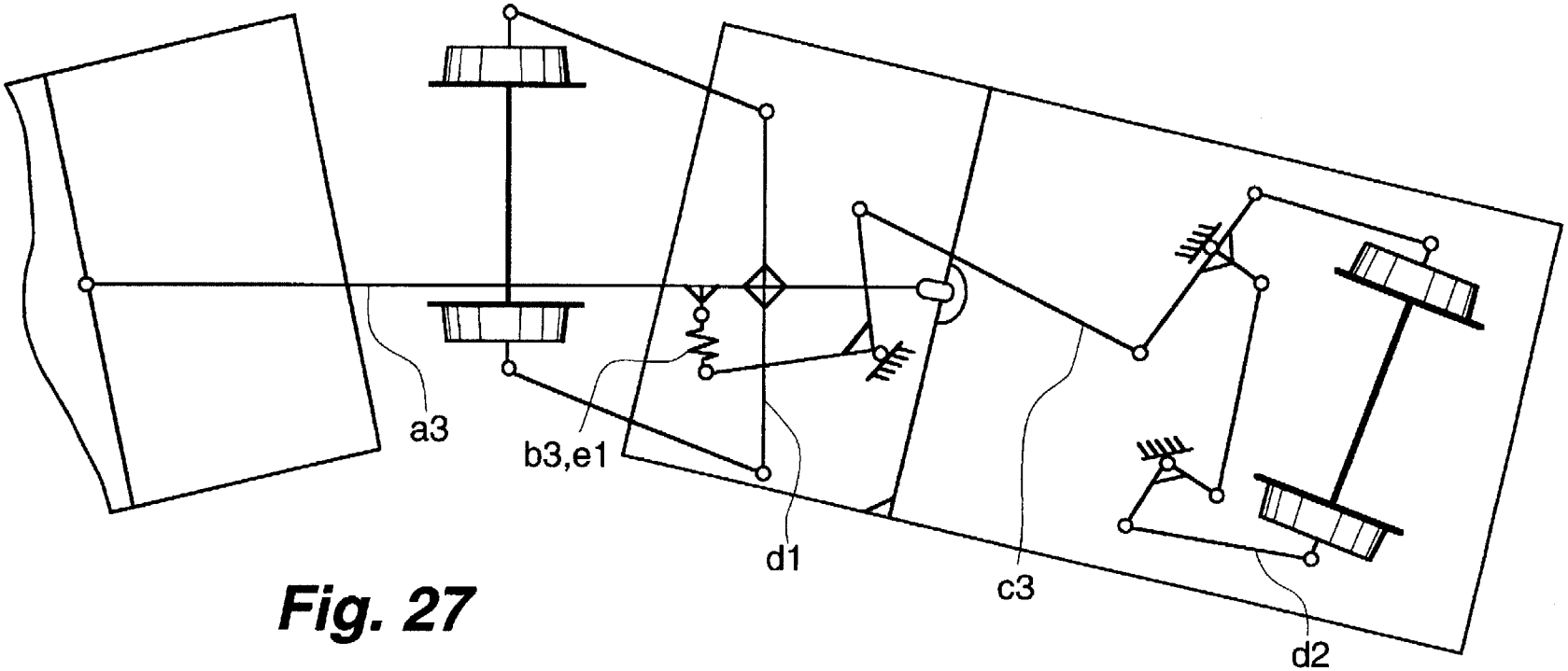
FIG. 27 is a schematic representation of another example according to the present invention, in which the self-steering elasticity is designed in connection with the device for steering angular movement pick-off (e1)

The example according to FIG. 27 is formed by the combination of the above-described elements a3, b3, e1, d1, and e3 of the solution matrix.

The example according to FIG. 28 is formed by the combination of the above-described elements a1, b1, c3, d3, and e3 of the solution matrix.

Further examples can also be assembled from the above-described solution matrix.

What is claimed is:

1. A railborne vehicle combination, comprising:

at least two vehicles with at least three steered single-wheelset chassis;

steering means;

steering signal generating means providing an angular position of two adjacent vehicles of the vehicle combination for steering the single-wheelset chassis;

transmission means for transmitting an amount of steering;

wheelset chassis coupling for positioning and turning the wheelset chassis in relation to an associated car body of said at least two vehicles; and self-steering means for providing a self-steering elasticity for the single-wheelset chassis, permitting self-steering of the single wheelset chassis in combination with substantially rigid said steering means.

2. A railborne vehicle combination according to claim 1, wherein:

said self-steering means is positioned within said steering signal generating means for providing the angular position of two adjacent vehicles.

3. A railborne vehicle combination according to claim 1, wherein:

said self-steering means is arranged within said steering angle transmission means.

4. A railborne vehicle combination according to claim 1, wherein:

said self-steering means is arranged within said chassis-turning means.

5. A railborne vehicle combination according to claim 1, wherein:

said self-steering device is arranged in said wheelset mounting means.

6. A railborne vehicle combination according to claim 1, wherein:

said self-steering means includes a self-steering elasticity arranged within one of said steering angle means, said steering angle transmission means, said chassis turning means, and said wheelset mounting means.

7. A rail borne vehicle combination, comprising:

a first vehicle having a first vehicle chassis, said first vehicle chassis being pivotably connected to said first vehicle for steering said first vehicle;

a second vehicle pivotably connected to said first vehicle, said second vehicle having a second vehicle chassis, said second vehicle chassis being pivotably connected to said second vehicle for steering said second vehicle;

vehicle steering signal generating means for generating a vehicle steering signal dependent on an angular relationship between said first vehicle and said second vehicle;

transmission means for transmitting said vehicle steering signal from said vehicle steering signal generation means to at least one of said first and second vehicle chassis;

chassis turning means connected to said transmission means and said at least one of said first and second vehicle chassis, said chassis turning means turning said at least one of said first and second vehicle chassis dependent on said vehicle steering signal;

chassis self-steering means for providing elasticity in positioning of said at least one of said first and second vehicle chassis for self-steering of said chassis.

8. A railborne vehicle combination according to claim 7, wherein:

said chassis self-steering is in addition to said vehicle steering signal.

9. A railborne vehicle combination according to claim 7, wherein:

said chassis self-steering means is arranged within said transmission means.

10. A railborne vehicle combination according to claim 7, wherein:

said self-steering elasticity of said chassis self-steering means is positioned in one of said vehicle steering angle generating means, said transmission means, and said chassis turning means.

11. A railborne vehicle combination according to claim 7, wherein:

said chassis self-steering means is positioned within said steering signal generating means.

12. A railborne vehicle combination according to claim 7, wherein:

said chassis self-steering means is arranged within said transmission means.

13. A railborne vehicle combination according to claim 7, wherein:

said chassis self-steering means is arranged within said chassis-turning means.

* * * * *